US005713458A

United States Patent [19]

Johnson et al.

[11] Patent Number: 5,713,458

[45] Date of Patent: Feb. 3, 1998

[54] BUBBLE BUTTON

[75] Inventors: Charles H. Johnson, Chicago; Edward F. Brooks, Skokie, both of Ill.

[73] Assignee: Superior Holdings of America, Inc., Morton Grove, Ill.

[21] Appl. No.: 597,946

[22] Filed: Feb. 7, 1996

[51] Int. Cl.[6] ..... H01H 9/18

[52] U.S. Cl. ..... 200/314; 200/312

[58] Field of Search ..... 200/314, 315, 200/316, 312

[56] References Cited

U.S. PATENT DOCUMENTS

| | | | |
|---|---|---|---|
| 1,144,743 | 6/1915 | Upjohn . | |
| 2,301,506 | 11/1942 | Bean . | |
| 2,704,211 | 3/1955 | Decepoli . | |
| 3,188,437 | 6/1965 | Lauren et al. | 200/314 X |
| 4,096,368 | 6/1978 | Grebner | 200/314 |
| 4,154,657 | 5/1979 | Dennen . | |
| 4,352,776 | 10/1982 | Weisner et al. . | |
| 4,451,874 | 5/1984 | Friedman . | |
| 4,463,237 | 7/1984 | Kim . | |
| 4,480,833 | 11/1984 | Barcelow et al. . | |
| 4,498,670 | 2/1985 | Peters . | |
| 4,575,086 | 3/1986 | Kim et al. . | |
| 4,823,525 | 4/1989 | Roberts et al. . | |
| 4,937,408 | 6/1990 | Hattori et al. | 200/314 |
| 5,031,918 | 7/1991 | Brill . | |
| 5,197,741 | 3/1993 | Wu . | |
| 5,434,377 | 7/1995 | Martin et al. | 200/314 |

FOREIGN PATENT DOCUMENTS

| | | | |
|---|---|---|---|
| 3923747 | 1/1991 | Germany | 200/314 |

*Primary Examiner*—Renee S. Luebke
*Attorney, Agent, or Firm*—Emrich & Dithmar

[57] ABSTRACT

A manually operable "bubble" button for an amusement device, such as an arcade game, includes inner and outer nested, generally cup-shaped members formed of suitable plastic material. The inner member has an annular flange which seats on an annular shoulder of the outer member to limit the depth of insertion so that the concave wall portions of the members are spaced apart. Circumferentially spaced ribs on the inner member engage the outer member to center the members and a locating tab on the inner member seats in a recess in the outer member to ensure proper relative orientation of the members. An indicium is disposed between the inner and outer members, preferably being fixed to the inner member, at least the outer member being substantially transparent to visible light so that the indicium can be seen therethrough. The members are fixed together adjacent to their open ends.

17 Claims, 1 Drawing Sheet

BUBBLE BUTTON

BACKGROUND OF THE INVENTION

1. Field of the Invention

The present invention relates to amusement devices, such as arcade games, and in particular, to manually operable buttons for such devices, sometimes referred to as "bubble" buttons.

2. Description of the Prior Art

A number of different types of arcade games and other similar amusement devices incorporate manually operable buttons of the type sometimes referred to as "bubble" buttons. These bubble buttons are generally dome-shaped devices which typically carry some sort of indicium and may cover a suitable light source. The button is designed to be struck or actuated with a user's hand or a hand-manipulated implement, so as to depress the button to actuate an associated switch or the like, which may cause illumination of the light source and/or other suitable responses.

A difficulty with prior art bubble buttons has been the placement of the indicium thereon. In some prior art bubble buttons the indicium is applied to the outer surface of the dome of the button. However, because this outer surface comes in contact with the user's hand or other actuating implement, it tends to be worn away. It is known to place the indicium on the inner surface of the dome of the button, but this is difficult and expensive. Because of the size and shape of the button, it is typically not practicable to apply the indicium to the inside of the dome after it has been formed.

If the button, which is typically formed of a plastic material, is formed by molding, it is not possible to apply the indicium before molding. If the dome of the button is drawn or vacuum formed from a flat sheet of plastic material, it is possible to apply the indicium to the inner surface of the sheet before forming. However, in this case the indicium must be "distorted" as originally applied so that, after formation, it will assume the desired size and shape. Also, it is essential that the "distorted" indicium be very accurately positioned so that, after formation, it will appear in the proper location on the dome. This process is costly and results in a high degree of breakage since, as a result of the vacuum formation, the formed areas become thinner and stress is created making the part more susceptible to breakage. In order to avoid this, it is necessary to start with thicker material, which adds to the material expense.

SUMMARY OF THE INVENTION

It is a general object of the invention to provide an improved bubble button construction which avoids the disadvantages of prior constructions while affording additional structural and operating advantages.

An important feature of the invention is the provision of a manually operable button for an amusement device which carries an indicium visible to, but not accessible by, a user.

In connection with the foregoing feature, another feature of the invention is the provision of a button of the type set forth, which has the necessary strength to withstand substantial contact in use.

In connection with the foregoing features, a further feature of the invention is the provision of a button of the type set forth which can be formed by injection molding.

A still further feature of the invention is the provision of a button of the type set forth which is of simple and economical construction.

Certain ones of these other features of the invention are attained by providing a manually operable button for an amusement device comprising: an outer member including a first wall portion having an inner surface defining a hollow cavity, an inner member having a second wall portion with an outer surface and shaped and dimensioned to be mateably received in the cavity in an assembled condition with the outer surface facing the inner surface of the first wall portion, and an indicium disposed on the outer surface of the second wall portion, the first wall portion being sufficiently light transmitting that the indicium is visible therethrough in the assembled condition.

Further features of the invention are attained by providing a manually operable button for an amusement device comprising: outer and inner concave members fixedly secured together in a nested configuration, the outer and inner members respectively having first and second spaced-apart wall portions, and an indicium disposed between the first and second wall portions, the first wall portion being sufficiently light transmitting that the indicium is visible therethrough.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
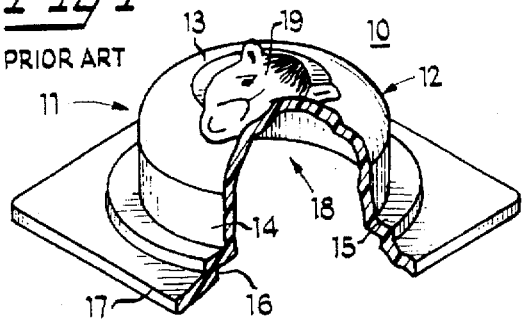
Fig 1 PRIOR ART
FIG. 1 is a perspective view of a prior art button with portions broken away to show the internal construction.
Figure 3:
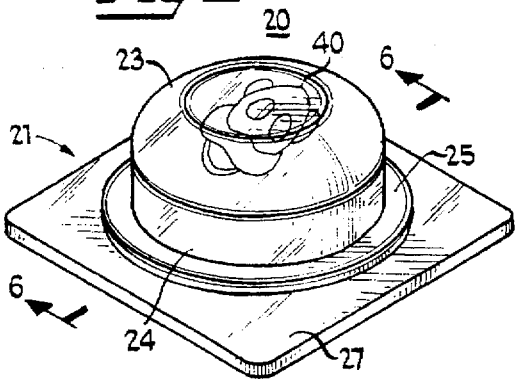
FIG. 3 is a perspective view of the assembled button of FIG. 2.
Figure 3:
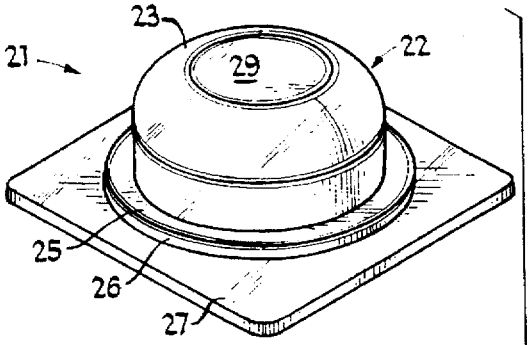
Figure 4:
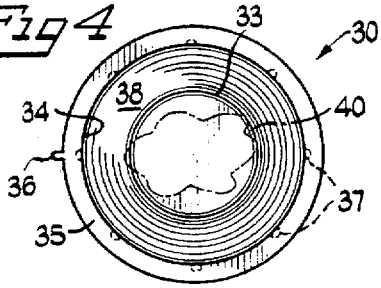
FIG. 4 is a top plan view of the inner member of the button of FIGS. 2 and 3.
Figure 2:
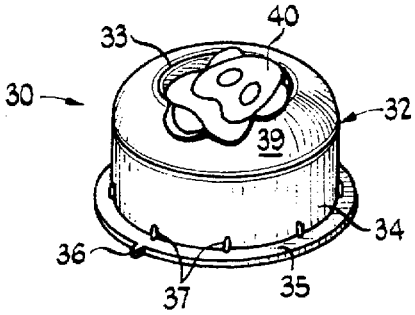
FIG. 2 is an exploded, perspective view of a button constructed in accordance with and embodying the features of the present invention.

Referring to FIG. 1, there is illustrated a prior art bubble button, generally designated by the number 10, of unitary, one-piece construction. Such a button is typically injection molded of a suitable plastic material and comprises a generally cup-shaped member 11 including a dome 12 having an end wall 13 and a cylindrical side wall 14. Integral with the side wall 14 at its open end is a laterally outwardly extending annular shoulder 15 which is, in turn, unitary at its outer edge with an axially outwardly extending cylindrical skirt 16. Integral with the skirt 16 at its distal edge around the entire circumference thereof is a laterally outwardly extending flange 17, substantially square in shape to facilitate attachment of the button 10 to an associated amusement device (not shown). The dome 12 defines a cavity 18 therein. Formed on the outer surface of the dome end wall 13 is an indicium 19 which may be a particular design or any other type of indicium pertinent to the particular amusement device. The indicium 19 may be in the form of a decal applied by suitable adhesive means or, alternatively, may be silk screened on the end wall 13.

In use, the bubble button 10 is mounted in place so that the flange 17 is disposed for engagement with and actuation of the contacts of one or more switches for performing suitable control functions. One such function may be the energization of a suitable light source (not shown), which may be disposed in the cavity 18. Typically, in operation of the amusement device, the bubble button 10 is arranged to be manually actuated by a user's hand or by manipulation of a suitable instrument, such as a mallet or the like, to strike the button 10. Upon such striking the button 10 is depressed to actuate the associate switch or switches which may, inter alia, illuminate the bubble button.

The difficulty with this prior art arrangement is that the indicium 19 come in contact with the user's hand or other striking implement and, consequently, tends to erode or wear away with use.

Figure 5:
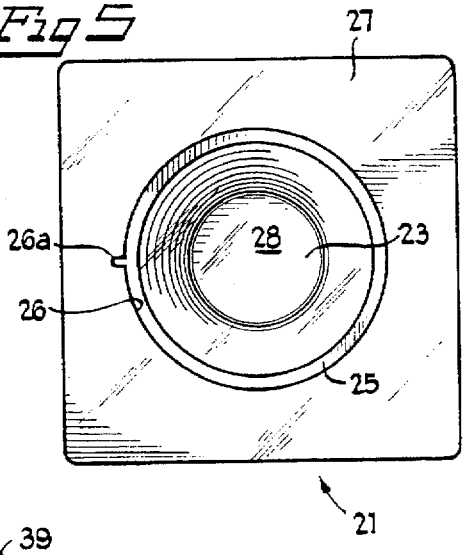
FIG. 5 is a bottom plan view of the outer member of the button of FIGS. 2 and 3.
Figure 6:
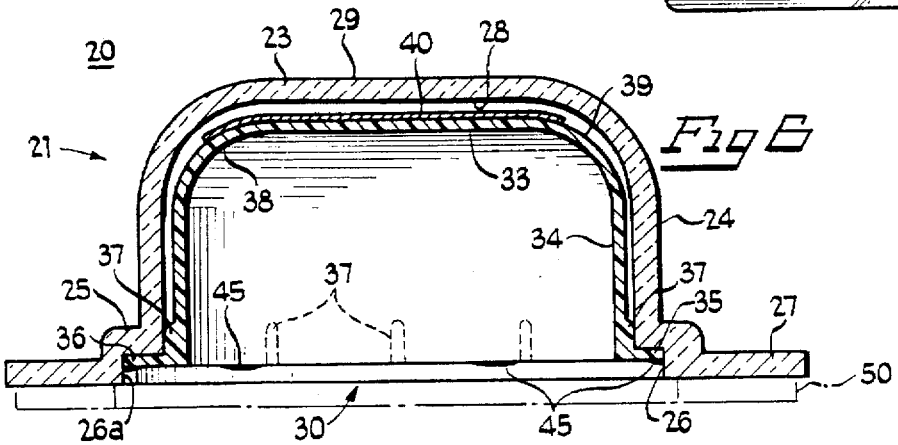
FIG. 6 is an enlarged view in vertical section taken along the line 6—6 in FIG. 3 and illustrating an associated cushion in phantom.

Referring now also to FIGS. 2–6, there is illustrated a bubble button 20, constructed in accordance with and embodying the features of the present invention. The bubble button 20 is of multi-part construction, including an outer member 21 and an inner member 30. The outer member 21 is generally cup-shaped, of unitary, one-piece construction, and may be substantially identical in shape to the prior art button 10. More particularly, the outer member 11 includes a dome 22 having an end wall 23 and a cylindrical side wall 24, unitary at its open end with a laterally outwardly extending annular shoulder 25. Integral with the shoulder 25 at its outer edge around the entire circumference thereof is a depending cylindrical skirt 26, having formed in the inner surface thereof a locating notch **26*a* (FIGS. 5 and 6). Unitary with the skirt 26 at its outer end around the entire circumference thereof and extending laterally outwardly therefrom is a flange 27, which may be generally square in shape. The dome 22 has an inner surface 28 and an outer surface 29, with the inner surface 28 defining a hollow cavity. Preferably, the outer member 21 is formed of a suitable plastic material by injection molding. Preferably, at least the dome 22** is formed of a material which is light-transmitting, preferably being substantially transparent to visible light.

The inner member 30 is also generally cup-shaped, defining a dome 32 having an end wall 33 and a cylindrical side wall 34 which is, in turn, unitary at its outer end with a laterally outwardly extending flange 35. Integral with the flange 35 and extending laterally outwardly therefrom is a short locating tab 36. Also integral with the outer surface of the side wall 34 adjacent to the flange 35 are a plurality of equiangularly spaced-apart centering ribs 37, each projecting laterally outwardly a slight distance from the side wall 34 and preferably having an axial extent only a small fraction of the length of the side wall 34. The dome 32 has an inner surface 38 and an outer surface 39. The inner surface 38 defines a hollow cavity. The inner member 30 is of unitary, one-piece construction, preferably being injection molded of a suitable plastic material.

The inner member 30 is shaped and dimensioned to be mateably nested within the cavity defined by the dome 22 of the outer member 21. More particularly, referring to FIG. 6, the flange 35 of the inner member 30 seats on the shoulder 25 of the outer member 21 to limit the depth of insertion, with the locating tab 36 disposed in the locating notch **26*a* to properly orient the inner member 30 relative to the outer member 21. The centering ribs 37 are dimensioned to engage the inner surface 38 of the dome 22 of the outer member 21 for centering the inner member 30 relative to the outer member 21. The parts are so dimensioned that when they are thus arranged in the assembled condition illustrated in FIG. 6, with the flange 35 seated on the shoulder 25, there is a slight gap between the domes 22 and 32. It is a fundamental aspect of the present invention that a suitable indicium 40 is disposed in that gap, preferably between the end walls 23 and 33**.

When the parts are thus assembled with the inner member flange 35 seated on the outer member shoulder 25, as illustrated in FIG. 6, the inner and outer members 30 and 21 are fixedly secured together by any suitable means. In FIG. 6, there are shown a plurality of ultrasonic weldments 45 between the flange 35 and the shoulder 25. It will be appreciated, however, that other attachment means, such as a suitable adhesive, could also be used.

Preferably, the indicium 40 is applied to the outer surface 39 of the inner member dome 32 before assembly with the outer member 21. This indicium 40 may be in the nature of a decal adhesively secured to the dome 32, or it may be silk screened thereon or applied by any other suitable process. Preferably, the indicium 40 is disposed along the end wall 33 of the dome 32. The dome 22 of the outer member 21 is formed of a material which is sufficiently light-transmitting that the indicium 40 can be viewed therethrough. While a substantially transparent dome 22 is preferred, it will be appreciated that the dome 22 could be translucent, depending upon the particular application. The dome 22 may be clear or colored, as desired. As is illustrated in FIG. 6, a suitable cushion 50 formed of a material, such as foamed rubber or the like, may be adhesively secured to the bottom surface of the outer member flange 27.

It will be appreciated that, because of the construction of the bubble button 20 from discrete inner and outer members 30 and 21, the indicium 40 may be easily applied to an outer surface of the inner member 30 while, at the same time, being completely protected in use from contact with a user's hand or other manipulated implement and, at the same time, being clearly visible to the user. Furthermore, because of this two-part construction, both the inner and other members 30 and 21 may be formed by injection molding, thereby resulting in a sturdy and inexpensive construction, while making the most efficient use of the plastic material.

While, in the illustrated embodiment, the indicium 40 is secured to the outer surface 39 of the inner member dome 32, this is not essential. Thus, the indicium 40 might be trapped between the inner and outer members 30 and 21. Also, it will be appreciated that the light-transmitting properties of the inner member 30 may not be as important as those of the outer member 21. Nevertheless, the inner member 30 may be formed of a suitable transparent or translucent material so as to effectively transmit the light from a lamp or other light source which might be disposed in the cavity of the inner member 30. Preferably, the inner member 30 is formed of a colored material which will be visible through the outer member 21.

From the foregoing, it can be seen that there has been provided an improved bubble button which is of economical yet sturdy construction and permits easy application of an indicium which is, nevertheless, completely protected in use.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A manually operable button for an amusement device comprising: an outer member including an annular shoulder and a first wall portion having an inner surface defining a hollow cavity, an inner member having a second wall portion with an outer surface and shaped and dimensioned to be mateably received in said cavity in an assembled condition with said outer surface facing said inner surface of said first wall portion, an annular flange on said inner member engageable with said shoulder in the assembled condition for limiting the depth of insertion of said member in said cavity, means non-removably fixedly securing said inner and outer members together, and an indicium disposed on said outer surface of said second wall portion, said first wall portion being sufficiently light transmitting that said indicium is visible therethrough in said assembled condition.

2. The button of claim 1, and further comprising a substantially cylindrical skirt integral with said shoulder and projecting therefrom, and a recess formed in said skirt, said inner member having a locating projection receivable in use in said recess for ensuring the proper orientation of said inner member relative to said outer member in the assembled condition.

3. The button of claim 2, and further including a flange integral with said skirt and projecting laterally outwardly therefrom around the entire circumference thereof.

4. A manually operable button for an amusement device comprising: an outer member including a first wall portion having an inner surface defining a hollow cavity, an inner member having a second wall portion with an outer surface and shaped and dimensioned to be mateably received in said cavity in an assembled condition with said outer surface facing said inner surface of said first wall portion, means non-removably fixedly securing said inner and outer members together, and an indicium non-removably fixed to said outer surface of said second wall portion, said first wall portion being sufficiently light transmitting that said indicium is visible therethrough in said assembled condition.

5. The button of claim 4, wherein each of said inner and outer members is formed of a plastic material.

6. The button of claim 4, and further comprising a recess formed in said outer member, and a locating projection carried by said inner member and receivable in said recess for ensuring proper orientation of said inner member relative to said outer member in the assembled condition.

7. The button of claim 4, wherein each of said first and second wall portions is substantially cup-shaped.

8. The button of claim 4, wherein said means fixedly securing includes ultrasonic weldments.

9. The button of claim 4, wherein said first and second wall portions are spaced apart in the assembled condition.

10. The button of claim 9, wherein said inner member includes a plurality of spaced-apart centering projections engageable with said outer member in the assembled condition for centering said inner member in said cavity.

11. The button of claim 4, wherein said first wall portion is substantially transparent to visible light.

12. The button of claim 11, wherein said first wall portion is clear.

13. The button of claim 11, wherein said first wall portion is colored.

14. A manually operable button for an amusement device comprising: outer and inner concave members non-removably fixedly secured together in a nested configuration, said outer and inner members respectively having first and second spaced-apart wall portions, and an indicium disposed between said first and second wall portions and non-removably fixed to said second wall portion, said first wall portion being sufficiently light transmitting that said indicium is visible therethrough.

15. The button of claim 14, wherein said first wall portion is substantially transparent to visible light.

16. The button of claim 14, wherein said inner member includes a plurality of spaced-apart centering projections engageable with said outer member in the nested configuration for centering said inner member in said cavity.

17. The button of claim 14, and further comprising a recess formed in said outer member, and a locating projection carried by said inner member and receivable in said recess for ensuring proper orientation of said inner member relative to said outer member in the nested configuration.

* * * * *